United States Patent [19]

Koiwa et al.

[11] Patent Number: 4,899,715

[45] Date of Patent: Feb. 13, 1990

[54] IGNITION DEVICE FOR INTERNAL COMBUSTION ENGINE

[75] Inventors: Mitsuru Koiwa; Kouichi Okamura, both of Hyogo, Japan

[73] Assignee: Mitsubishi Denki Kabushiki Kaisha, Tokyo, Japan

[21] Appl. No.: 249,735

[22] Filed: Sep. 26, 1988

[51] Int. Cl.[4] ..... F02P 3/04

[52] U.S. Cl. ..... 123/644

[58] Field of Search ..... 123/644, 651, 609, 632; 315/209 T

[56] References Cited

U.S. PATENT DOCUMENTS

| | | | |
|---|---|---|---|
| 4,245,610 | 1/1981 | Suguira | 123/644 |
| 4,248,200 | 2/1981 | Sugiura et al. | 123/644 |
| 4,267,813 | 5/1981 | Hohne et al. | 123/644 |
| 4,356,807 | 11/1982 | Tokura et al. | 123/644 |
| 4,359,038 | 11/1982 | Xiberas | 123/644 |
| 4,402,299 | 9/1983 | Nakao et al. | 123/644 |
| 4,469,082 | 9/1984 | Nishitoba et al. | 123/644 |

*Primary Examiner*—Raymond A. Nelli

*Attorney, Agent, or Firm*—Sughrue, Mion, Zinn, Macpeak & Seas

[57] ABSTRACT

An ignition device for an internal combustion engine includes a transistor circuit used to turn a primary current of an ignition coil on and off to produce a high voltage for spark ignition. A reference voltage generator produces a temperature compensated reference voltage. A primary current detecting circuit produces a voltage corresponding to a primary current of the ignition coil. A comparator compares the temperature compensated reference voltage with the voltage produced by the primary current detecting circuit. A control circuit responsive to an output of the comparator controls a base voltage of the transistor circuit to a predetermined constant value.

3 Claims, 2 Drawing Sheets

IGNITION DEVICE FOR INTERNAL COMBUSTION ENGINE

BACKGROUND OF THE INVENTION

The present invention relates to an ignition device for an internal combustion engine and, particularly, to a device for limiting a primary current of an ignition coil thereof.

FIG. 3 shows an example of a conventional ignition device of this type, in which a reference numeral 1 depicts a power source, 2 an ignition coil, 3 an ignition device and 4 and 5 are a resister and a transistor, respectively, constituting a circuit for producing a drive signal for the ignition device.

The ignition device 3 includes an output terminal 31 connected to the ignition coil 2, a grounding terminal 32 and an input terminal 33 connected to the circuit. When the transistor 5 of the circuit is on/off operated, a signal is supplied to the input terminal 33 of the ignition device 3 such that, upon a turn-off of the transistor 5, a current flows from the power source 1 through the resister 4 and an internal resistance 303 of the ignition device to a base of a Darlington power transistor 301 to turn the latter on to thereby supply a primary current to the ignition coil 2.

A primary current detecting resister 302 is provided between an emitter of the power transistor 301 and a grounding point so that a voltage across the resister 302 increases with an increase of the primary current.

A transistor 307 has a base connected through a resister 304 to the emitter of the power transistor 301, an emitter grounded and a collector connected to the base of the power transistor 301. Between the base and the emitter of the transistor 307, a circuit constituted with a resister 305 and a transistor 306 is connected. When a voltage across the primary current detecting resister 302 exceeds a turn-on voltage of the transistor 307, a current flows through the resister 304 to the base of the transistor 307 and the resister 305. The collector of the transistor 307 absorbs a portion of the base current of the power transistor 301 correspondingly to a degree of conduction of the transistor 307.

The primary current of the ignition coil is limited to a constant value when a balance condition determined by the base current of the power transistor 301, the voltage across the primary current detecting resister 302, the base current of the transistor 307 and a current amplification factor of the transistor circuit composed of the power transistor 301 and the transistor 307 is satisfied.

The collector and the base of the transistor 306 are short-circuited so that it functions as a diode. That is, a temperature dependency of the base-emitter voltage of the transistor 307 is compensated for by a temperature dependency of base-emitter voltage of the transistor 306 to thereby solving a temperature dependency problem of current limitation.

With such scheme as mentioned above, the primary current of the ignition coil is limited to a constant value which is just enough for ignition, allowing a use of a relatively small power transistor.

In the conventional device mentioned above, however, the constant primary current means that a current amount to be absorbed by the transistor 307 is constant, while the base current of the transistor 301 varies with a variation of the source voltage. That is, it is impossible to obtain a constant current limitation value when the source voltage varies. For example, when the source voltage increases, the base current of the power transistor 301 increases correspondingly. In order to absorb a current increment by means of the transistor 307, it is necessary to increase the voltage across the primary current detecting resister, i.e., to increase the primary current, requiring a large power transistor. On the contrary, when the source voltage decreases, the current limit value is lowered, causing an output of a secondary coil of the ignition coil to be lowered or a heat generation problem to occur.

It is usual that the transistor 306 provided for compensation of temperature denpendency of the current limit value is not enough to cancel out a temperature dependent variation of a base-emitter voltage of the transistor 307 and that, due to the fact that the primary current detecting resister 302 is of a metal having resistance varying with temperature, the current limit value is large at low temperature and small at high temperature.

SUMMARY OF THE INVENTION

An object of the present invention is to provide an ignition device for an internal combustion engine which is capable of maintaining a current limit value constant for a variation of a source voltage and for a variation of temperature.

According to the present invention, the above object can be achieved by an ignition device which comprises a primary current detection circuit, a reference voltage generator having a temperature compensation function, a comparator and a control circuit. The reference voltage generator generates a constant reference voltage regardless of source voltage variation and has a temperature compensation function.

DETAILED DESCRIPTION OF THE PREFERRED EMBODIMENT

Figure 1:
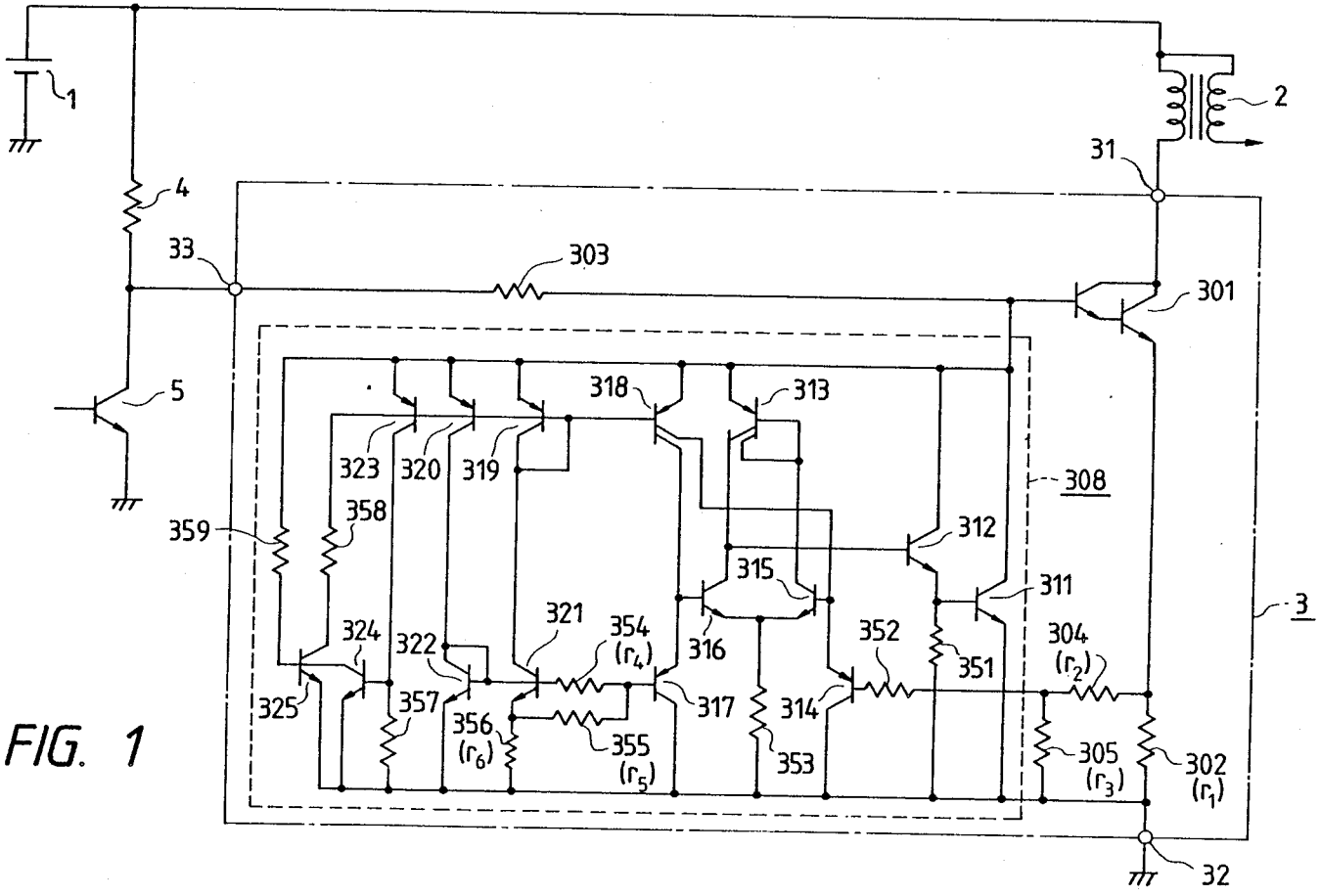
FIG. 1 is a circuit diagram of an ignition device for an internal combustion engine according to an embodiment of the present invention.

In FIG. 1, a power source and an ignition are depicted by reference numerals 1 and 2, respectively, and an ignition device according to the present invention is depicted by a reference numeral 3. A transistor 5 is on-off controlled by an output signal of a control device which is not shown and has a collector connected to an input terminal 33 of the ignition device 3 and to a terminal of a resister 4 whose other terminal is connected to the power source 1. The transistor 5 supplies a drive signal for the ignition device 3. The latter has an output terminal 31, a grounding terminal 32 and an input terminal 33, as in the conventional device, and the output terminal 31 is connected to a primary terminal of the ignition coil 2.

The input terminal 33 of the ignition device 3 is connected through an input protection resister 303 to a power transistor 301 and a constant current control circuit 308 and the output terminal 31 is connected to a collector of the power transistor 301. A primary current detecting resister 302 having a resistance R1 for detecting a current of the primary coil of the ignition coil is connected between an emitter of the power transistor 301 and a grounding point 32, in parallel with series connected resisters 304 and 305 having resistances R2 and R3, respectively. A junction of the resisters 304 and 305 is connected through a resister 352 to one of two input terminals of a comparator composed of transistors 313 to 318 and a resister 353 of a constant current control circuit 308. The other input of the comparator is connected to an output of a reference voltage generator composed of transisters 319 to 322 and resisters 354, 355 and 356 having resistances R4, R5 and R6, respectively. A transistor 325 and resisters 358 and 359 constitute an actuation circuit for the reference voltage generator and the comparator and transisters 323 and 324 and a resister 357 constitute a circuit for making the actuation circuit inoperative after the reference voltage generator and the comparator start to operate.

Figure 2:
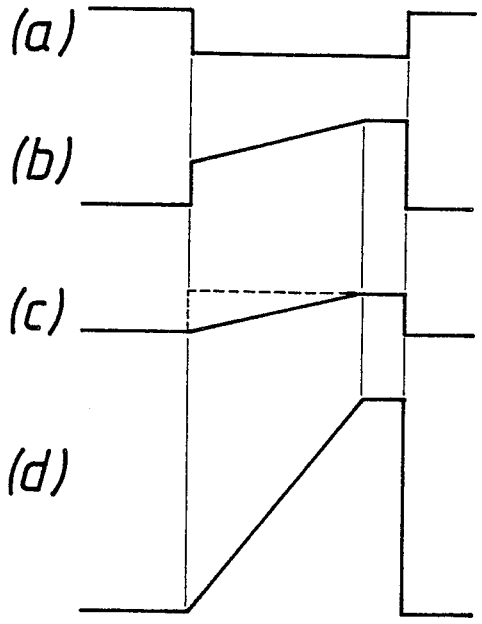
FIG. 2 shows waveforms at various points in the circuit shown in FIG. 1.
Figure 3:
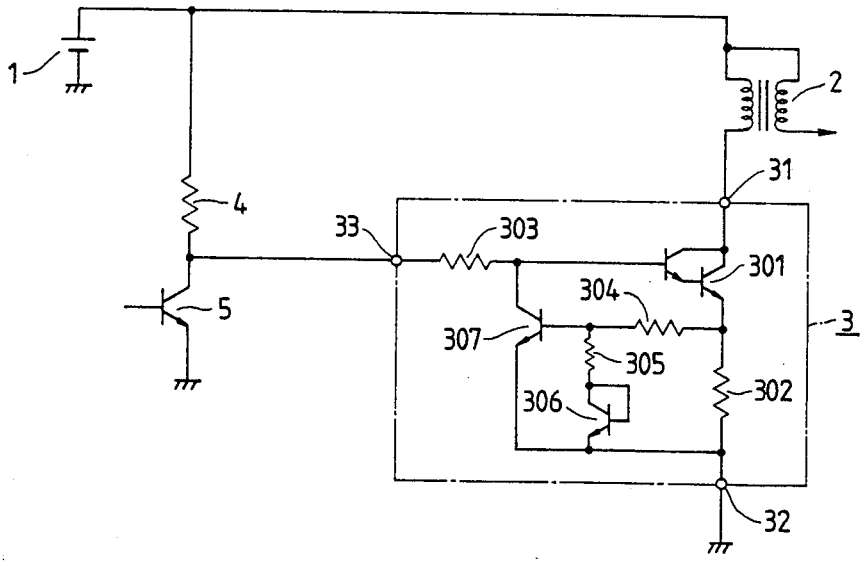
FIG. 3 is a circuit diagram of a conventional ignition device.

In operation, when the base voltage of the transistor 5 becomes "L" level as shown in waveform a in FIG. 2, the latter is turned off and a current flows from the power source 1 through the resisters 4 and 303 to the base of the power transistor 301 to turn the latter on. A base voltage of the power transistor 301 at this time becomes equal to a base-emitter voltage thereof. Upon the conduction of the power transistor 301, a primary current flowing through the resister 302 increases as shown by a waveform d shown in FIG. 2, upon which a voltage across the primary current detecting resister 302 increases correspondingly. Therefore, the base voltage of the power transistor becomes a sum of the above mentioned base-emitter voltage and the incremented voltage across the resister 302, which is shown by a waveform b in FIG. 2. It is known that the base-emitter voltage of a power transistor which is of the Darlington type is in the order of 1.4 V. When a base voltage of the power transistor by which the latter is turned on is applied to the constant current control circuit 308, the transistor 325 is first turned on and absorbs a current from the bases of the transistors 318 to 320 and 323 which constitute a current mirror circuit through the resister 358 to thereby turn the transistors 318 to 320 and 323 of the current mirror circuit on. Then, when the transistors 322 and 321 are turned on by a collector current of the transistor 320, a voltage is produced across the resister 356 the value of which depends upon an emitter current ratio between the transistors 322 and 321. A current flowing through the current mirror circuit is determined by the produced voltage across the resister 356 and its resistance value R6. A voltage produced across the resister 357 by a current supplied from the transistor 323 turns the transistor 324 on and transistor 325 of the actuation circuit off.

If the amplification factor of a transistor is large enough, an emitter current thereof is substantially equal to its collector current. When a sum of the resistances of the resisters 354 and 355 connected between the base-emitter of the transistor 321 is set large such that a current flowing from the resister 355 to the resister 356 is small compared with the emitter current of the transistor 321, a current flowing from the collector of the transistor 320 to the resister 354 is small compared with the collector current of the transistor 320. Therefore, the emitter current of the transistor 321 becomes equal to the current flowing through the resister 356 and the emitter current of the transistor 322 becomes equal to the collector current of the transistor 320.

The current I1 flowing through the resister 356 is determined by the resistance R6 of the resister 356 and a difference $\Delta V_{BE}$ between the base-emitter voltage of the transistor 322 and the base-emitter voltage of the transistor 321. The current I1 and the difference $\Delta V_{BE}$ are given by the following equations:

$$I1=(\Delta V_{BE})/R6 \quad (1)$$

$$\Delta V_{BE}=(kT\ l_n\ ED322)/(q\ ED321) \quad (2)$$

where k=Boltzman constant

T=absolute temperature q=charge of electron

ED322=emitter current density of transistor 322

ED321=emitter current density of transistor 321

The ratio of current density between the transistors 321 and 322 in the equation (2) is given by the following equation since an error component thereof can be made negligible by setting the values R4 and R5 of the resisters 354 and 355 as mentioned previously.

$$(ED322)/(ED321)=(EA321)(EA320)/(EA322)(EA319) \quad (3)$$

where

EA321: emitter area of transistor 321

EA320: emitter area of transistor 320

EA322: emitter area of transistor 322

EA319: emitter area of transistor 319

The reference voltage Vref provided by the reference voltage generator circuit is supplied from a junction of the resisters 354 and 355 connected between the base and the emitter of the transistor 321 to a base of the transistor 317. The reference voltage Vref is shown by a dotted waveform c in FIG. 2 and given by the following equation:

$$Vref=\Delta V_{BE}+V_{BE}(321)(R5/(R4+R5)) \quad (4)$$

where $V_{BE}$ (321): base-emitter voltage of transistor 321.

The reference voltage generator circuit operates when the base voltage Vb(301) of the power transistor 301 satisfies the following condition:

$$Vb \geqq V_{BE}(322)+V_{CE}(320) \quad (5)$$

or $$Vb \geqq \Delta V_{BE}+V_{CE}(321)+V_{BE}(319) \quad (6)$$

where $V_{BE}$ (322): base-emitter voltage of transistor 322

$V_{CE}$ (320): collector-emitter saturation voltage of transistor 320

$V_{CE}$ (321): collector-emitter saturation voltage of transistor 321

$V_{BE}$ (319): base-emitter voltage of transistor 319

Since base-emitter voltage and collector-emitter voltage of a transistor are 0.7V and 0.1V, respectively, and $\Delta V_{BE}<0.25$, generally, it can be operated by the base voltage of the Darlington connected power transistor upon which the latter is turned on.

Since $\Delta V_{BE}$ in the first term of the right side of the equation (4) has a positive temperature dependency while the temperature dependency of $V_{BE}$(321) is usually $-2mV/C°$, the temperature dependency of the second term of the right side of the equation (4) can be negative by settings of the value R4 and R5 of the resisters 354 and 355, resulting in the reference voltage Vref having arbitrarily settable temperature dependency as a total.

The base of the transistor 314 which constitutes an input of the comparator circuit is supplied with a voltage through the resister 352 which is a fraction of the voltage generated across the primary current detecting resister 302 and derived from the junction between the resisters 304 and 305. The base voltage $V_B$ (314) of the transistor 314 is shown by a solid waveform c in FIG. 2 and given by the following equation:

$$V_B(314) = Ipr\ R1\ R3/(R2+R3) \quad (7)$$

where

Ipr: primary current of ignition coil

When $V_B$ (314) defined by the equation (7) is going to exceed the Vref given by the equation (4), a current is supplied from a junction between the collector of the transistor 316 and the collector of the transistor 313 which constitutes an output of the comparator to a base of the Darlington connected transistors 312 and 311 to make the latter conductive to thereby absorb the base current of the power transistor 301. Thus, a balance is established when Vref shown by the equation (4) becomes equal to the base voltage $V_B$ (314) shown by the equation (7), so that the primary current of the ignition coil can be limited to a constant current value.

The comparator circuit operates when the base voltage Vb of the power transistor 301 satisfies the following condition, $$Vb \geqq Vref + V_{CE}(315) + V_{BE}(313) \quad (8)$$

where $V_{CE}$ (315): collector-emitter saturation voltage of transistor 315.

$V_{BE}$ (313): base-emitter voltage of transistor 313.

Therefore, it can be operated reliably upon the base voltage of the power transistor upon which the latter is turned on.

The operating voltage of the Darlington transistors 312 and 311 is $$V_{BE}(311) + V_{BE}(312) + V_{CE}(313) \quad (9)$$

where $V_{BE}$(311): base-emitter voltage of transistor 311

$V_{BE}$(312): base-emitter voltage of transistor 312

$V_{CE}$(313): collector-emitter saturation voltage of transistor 313.

This is substantially the same as the base-emitter voltage of the Darlington power transistor when turned on. Since, however, the transistors 311 and 312 are to be operated only when the primary current is increased, the base voltage of the power transistor is increased as shown by the waveform b in FIG. 2 to a value much higher than the voltage defined by the equation (9) under such condition. Therefore, the constant current control circuit 308 which is operated by the base voltage of the Darlington power transistor 301 can regulate the current limit value to a constant value regardless of source voltage variation and temperature variation.

As described hereinbefore, according to the present invention by which it is possible to limit the primary current of the ignition coil to a constant value regardless of variations of source voltage and temperature, low rated transistors can be used with high reliability.

What is claimed is:

1. An ignition device for an internal combustion engine having transistor means for controlling a primary current of an ignition coil to produce a high voltage for spark ignition, comprising:

a reference voltage generator for producing a temperature compensated reference voltage which is independent of a source voltage;

a primary current detecting circuit for producing a voltage corresponding to said primary current of the ignition coil;

a comparator for comparing said temperature compensated reference voltage with said voltage produced by said primary current detecting circuit; and a control circuit responsive to an output of said comparator to control a base voltage of said transistor means to a predetermined constant value.

2. The ignition device as claimed in claim 1, further comprising an actuation circuit for actuating said comparator only when the primary current of the ignition coil increases above a predetermined value.

3. The ignition device as claimed in claim 1 or 2, wherein said reference voltage generator comprises a current mirror circuit and a pair of transistor circuits.

* * * * *